United States Patent [19]

Spells et al.

[11] Patent Number: 4,695,185

[45] Date of Patent: Sep. 22, 1987

[54] SEALANT APPLICATOR

[75] Inventors: Sherwood Spells; James R. Warren, both of Midland; Ronald W. Wieck, Bay City, all of Mich.

[73] Assignee: Dow Corning Corporation, Midland, Mich.

[21] Appl. No.: 708,601

[22] Filed: Mar. 5, 1985

[51] Int. Cl.[4] ..... E01C 23/02; E01C 23/09

[52] U.S. Cl. ..... 404/107; 404/111; 425/87; 141/311 R

[58] Field of Search ..... 404/107, 111; 425/87, 425/458; 401/266, 265, 261; 239/525; 156/578, 579; 141/311 R, 366, 1

[56] References Cited

U.S. PATENT DOCUMENTS

| | | | |
|---|---|---|---|
| 2,300,398 | 11/1942 | Ames | 425/87 X |
| 2,594,606 | 4/1952 | Ames | 425/87 |
| 2,824,443 | 2/1958 | Ames | 425/87 |
| 2,847,700 | 8/1958 | Knight | 425/458 X |
| 2,889,965 | 6/1959 | Ames | 425/87 X |
| 2,995,159 | 8/1961 | Berggren | 425/458 X |
| 3,020,812 | 2/1962 | Gross | 404/107 |
| 3,020,813 | 2/1962 | Gross | 404/107 |
| 4,502,814 | 3/1985 | Trimble | 404/107 |
| 4,570,834 | 2/1986 | Ward | 425/87 X |

FOREIGN PATENT DOCUMENTS

| | | | |
|---|---|---|---|
| 2721329 | 11/1978 | Fed. Rep. of Germany | 404/107 |
| 2948543 | 6/1981 | Fed. Rep. of Germany | 404/107 |

*Primary Examiner*—James A. Leppink
*Assistant Examiner*—Matthew Smith
*Attorney, Agent, or Firm*—Richard E. Rakoczy

[57] ABSTRACT

This disclosure relates to an applicator for placing a sealant into a groove, and comprises a member having a lower side, the lower side being adapted to extend into the groove. The lower side has an arcuate shape and a sealant passage extends through the member and includes an outlet opening in the lower side. The arcuate lower side is adapted to extend partially into said groove and engage the upper corners of the groove during use. The applicator further includes a limiter attached to the member, the limiter extending laterally of the lower side and over the upper corners of the groove.

4 Claims, 9 Drawing Figures

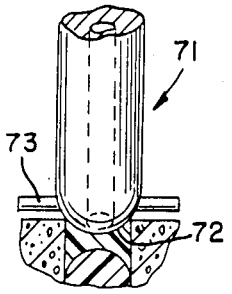
FIG. 9
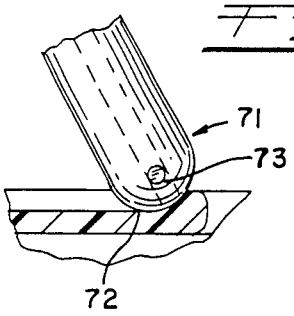
FIG. 8
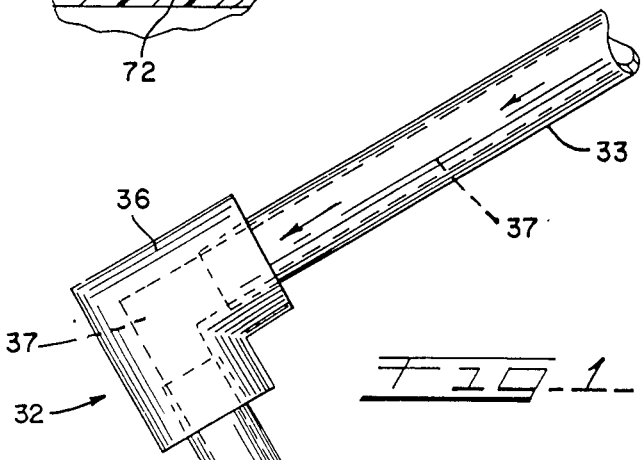
FIG. 1
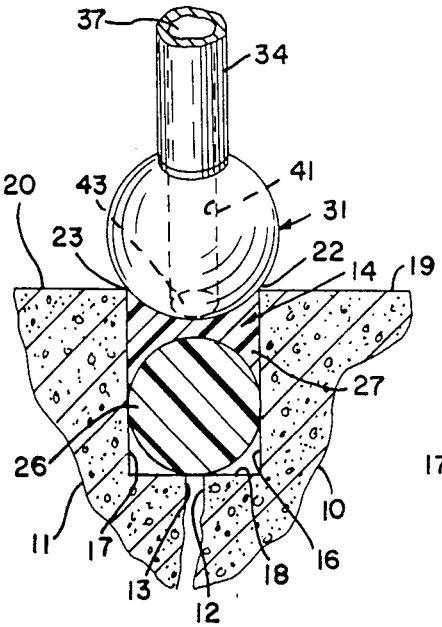
FIG. 2
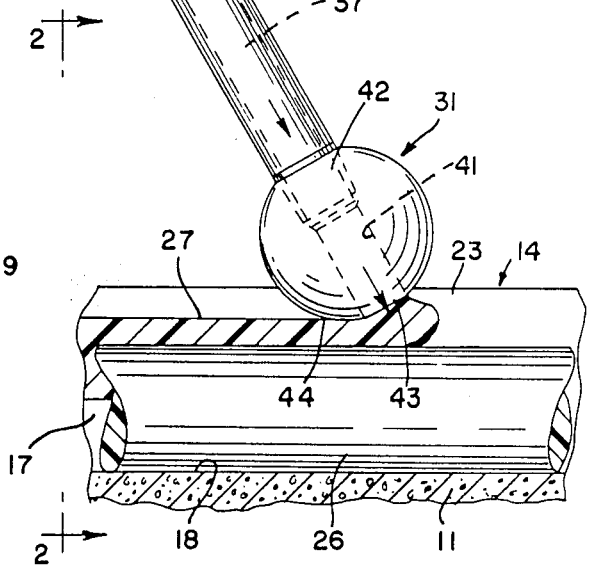

SEALANT APPLICATOR

FIELD AND BACKGROUND OF THE INVENTION

This invention relates to an applicator for dispensing a caulking compound or sealant into a groove or joint, particularly a groove in a highway pavement.

It is common practice to fill joints between adjoining parts with a caulking compound or sealant to prevent the entry of moisture or other material through the joint. For example, a concrete pavement is usually divided into sections which are separated by grooves to allow for expansion and contraction, and a sealant is placed in the grooves to prevent water from seeping through the grooves and damaging the pavement and to prevent stones and the like from entering the grooves and causing cracking of adjacent material as the pavement expands.

It is important that applicators for the sealant be able to operate effectively and rapidly. To be effective, the applicator should apply enough sealant to close the groove but should not waste sealant by inserting an excessive amount. Further the upper or outer surface of the sealant is preferably recessed slightly from the level of the pavement so that cars may be driven over it shortly after the sealant has been applied without having the tires stick to the sealant. The need to "tool" the surface of the sealant after it has been applied should also be minimized.

It is a general object of the present invention to provide a novel and improved applicator which meets the foregoing requirements.

BRIEF SUMMARY OF THE INVENTION

An applicator in accordance with the present invention is especially useful for applying a sealant in a sawed groove between two sections of a pavement. The applicator is attached to the outlet end of a sealant supply arm or tube, and the applicator is positioned in the groove with its outer surface engaging the upper corners of the groove. The surface of the applicator, where the applicator meets the groove, is semi-spherical, and a sealant outlet opening is located near the bottom of the applicator. The semi-spherical surface serves both to center the outlet opening between the sides of the groove and to tool the sealant to the optimum shape.

A depth limiter is preferably included in the applicator and comprises a member which extends laterally of the groove from the semi-spherical surface. The limiter functions to prevent the applicator from moving too deeply into the groove in the event of a chip, for example, out of the side of the groove.

BRIEF DESCRIPTION OF THE DRAWINGS

The invention will be better understood from the following detailed description taken in conjunction with the accompanying figures of the drawings, wherein:

FIG. 1 shows apparatus including an applicator in accordance with the present invention;

FIG. 2 is a fragmentary view taken on the line 2—2 of FIG. 1;

FIGS. 8 and 9 are views that are generally similar to FIGS. 3 and 4 but show still another form of the invention.

DETAILED DESCRIPTION OF THE DRAWINGS

Figure 3:
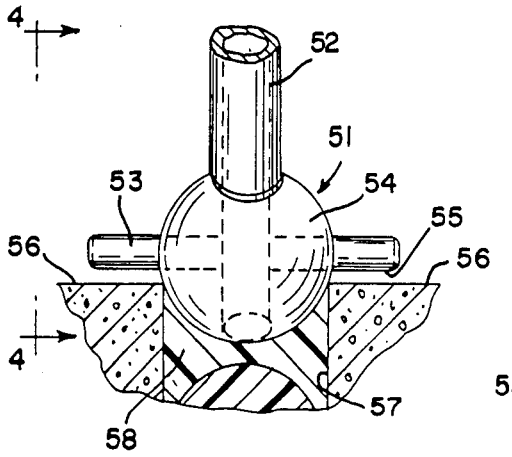
FIGS. 3 and 4 are views similar to FIGS. 1 and 2 but show an applicator including a limiter in accordance with the invention.

With reference first to FIGS. 1 and 2, two sections 10 and 11 of a concrete pavement are illustrated, the sections 10 and 11 having adjoining sides 12 and 13, respectively, which are normally slightly separated. Such pavement is typically made by pouring a continuous lane of concrete and then, when the concrete has partially set, sawing grooves across the concrete to cause it to divide into sections by cracking in the reduced cross-sectional areas below the saw cuts as it further cures and shrinks. The shrinkage thereby forms an expansion joint to allow for thermal expansion of the pavement without cracking. A second, wider but shallower sealant groove is often cut into the pavement along the original saw cuts some time after the original saw cut and after initial shrinkage of the pavement to provide a uniform groove for sealing between adjacent sections. Sealing is necessary in areas where freezing temperatures are encountered to prevent water from seeping through the expansion joints and into the substrate supporting the pavement where it can freeze and cause breakage of the pavement. A further reason for sealing arises from a need to keep stones and other hard debris from entering the grooves and causing breaking of the concrete adjacent the grooves.

As shown in FIGS. 1 and 2, the sawed sealant groove 14 is formed between the two adjacent sections 10 and 11 of pavement above the sides 12 and 13 of the expansion crack. The sawed sealant groove forms two vertical sides 16 and 17 and a bottom 18. The sides 16 and 17 join the upper surfaces 19 and 20 of the pavement at corners 22 and 23.

The groove 14 is sealed to prevent the entry of moisture and debris between the sides 12 and 13 of the joint, the seal being formed by a rod 26 formed of a plastic or foam material which is placed at the bottom of the groove 14 and extends along the length of the groove. Above the rod 26 and up to the surfaces 19 and 20 of the pavement is placed a sealant 27 which is applied by an applicator 31 in accordance with the present invention. The sealant 27 may, for example, comprise a silicone compound.

With specific reference to FIG. 1, the applicator 31 is mounted on the lower end of a supply arm 32 which, in the present illustration, is formed by two supply tubes 33 and 34 and by a connecting elbow 36. The elbow 36 makes threaded connections with the adjoining ends of the two tubes 33 and 34, and the tubes as well as the elbow 36 have passages 37 formed through them for the flow of a sealant from a supply (not shown) to the applicator 31. The supply may take the form, for example, of a drum of the sealant and a pump which draws the sealant from the drum and feeds it through the tubes under pressure.

In the form of the invention shown in FIGS. 1 and 2, the applicator 31 has a spherical outer surface, and a diametrically extending hole or passage 41 is formed through the sphere. One end 42 of the hole 41 is internally threaded and it is screwed onto the lower end of the supply arm 34, and the lower end of the hole 41 forms an outlet opening. The arm 34, during use of the applicator, is normally oriented so that it is in the vertical plane of the groove 14 and, of course, the hole 41 of the applicator 31 is also in this plane. The arm 34 and the hole 41 are slanted at, in the present specific example, an angle of approximately 60° from the surfaces 19 and 20 of the pavement and the arm 34 and the applicator 31 are moved from left to right as seen in FIG. 1, which is in the direction away from the angle of slant. As a consequence, the outlet opening 43 is slightly forward, in the direction of movement, of the center of the applicator, and when the sealant 27 leaves the outlet opening 43, it tends to flow forwardly slightly as shown in FIG. 1. The lower surface 44 of the sphere then moves across the upper surface of the sealant 27, and it will be apparent from FIG. 2 that the lower surface 44 shapes or tools the sealant 27.

The diameter, or lateral dimension, of the spherical applicator 31 is larger than the lateral width of the groove 14, and consequently the lower side 44 of the applicator 31 normally rests on the corners 22 and 23 of the groove. Therefore the lower side 44 extends downwardly a short distance into the groove 14 at the center of the groove but it is spaced from the upper surface of the rod 26.

As a specific example, where the lateral width of the sawed groove 14 and the diameter of the rod 26 are approximately 1", the vertical depth of the groove is approximately $1\frac{3}{4}$" and the diameter of the spherical applicator 31 is approximately $1\frac{1}{4}$". The lowermost surface of the applicator 31 therefore extends approximately $\frac{1}{4}$" into the groove below the level of the surfaces 19 and 20 but is spaced from the rod 26 by approximately $\frac{1}{2}$". As shown in FIG. 2, from the lowermost point of the spherical applicator, the surface 44 and the upper surface of the sealant curve smoothly up to the corners 22 and 23. An arcuate recess is thereby formed in the sealant. The concave configuration of the sealant bead provides a large area for adhesion to the groove surfaces 16, 17. It also provides for a relatively thin cross-section at the center of the groove allowing greater stretch without tearing as the pavement contracts and the groove expands and allows compression of the material in the groove to accommodate expansion of the pavement without squeezing the sealant material above the top level of the pavement where it can be damaged by passing traffic.

Figure 4:
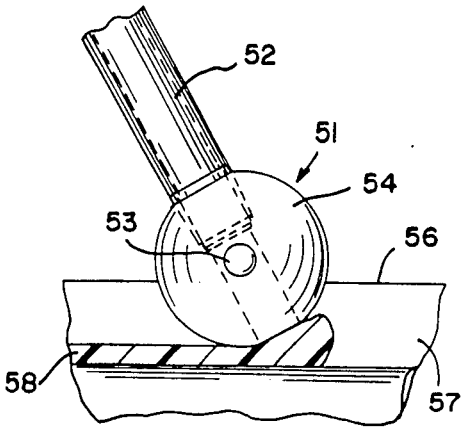

FIGS. 3 and 4 illustrate an applicator 51 fastened to the lower end of a supply tube 52, the arrangement being similar to that shown and described in connection with FIGS. 1 and 2. In addition, the applicator 51 includes a limiter 53 which, in this embodiment of the invention, is formed by a laterally extending round pin. The limiter 53 is located on the spherical part 54 of the applicator so that its lowermost surface 55 is normally spaced slightly above the upper surface 56 of the pavement. However, in the event there is a chip out of the pavement at a corner of the groove 57, the limiter 53 will prevent the spherical part 54 from dropping down into the groove 57 by an excessive amount. Thus, the limiter 53 serves to limit the maximum depth or penetration of the applicator into the groove 57. As will be described in connection with FIG. 5, the lower surface 55 of the limiter 53 also functions to smooth the upper surface of any of the sealant 58 that enters an opening formed by a chip.

Figure 5:
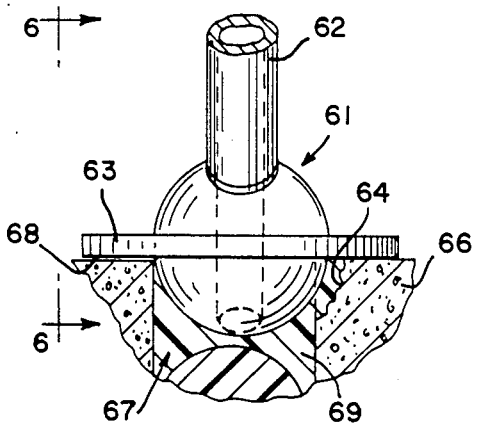
FIGS. 5 and 6 are views similar to FIGS. 3 and 4 but show an alternate form of the invention.
Figure 6:
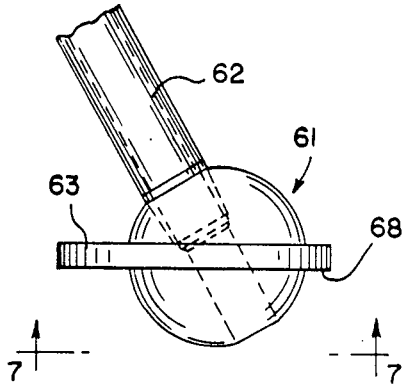
Figure 7:
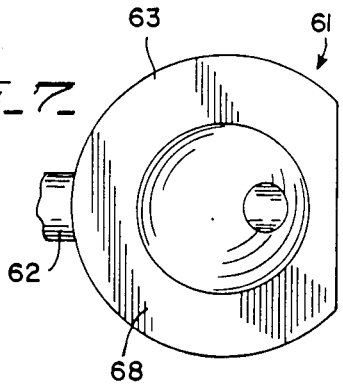
FIG. 7 is a view taken on the line 7—7 of FIG. 6.

With reference to FIGS. 5, 6 and 7, the applicator 61 is fastened to the lower end of a supply tube 62 and again includes a limiter 63. In this embodiment of the invention, the limiter 63 is formed by a circular plate which is best shown in FIG. 7. The plate 63 extends laterally outwardly over the sides of the groove and functions similarly to the pin 53. In FIG. 5, the reference numeral 64 indicates a chip out of a section 66 of pavement. Due to the chip opening 64, the lateral width of the groove 67 is greater than the diameter of the sphere, and consequently the sphere tends to move downwardly into the groove and opening formed by the chip 64. However, a substantial downward movement of the applicator is prevented by the limiter 63 which engages the upper surfaces of the pavement sections. The undersurface 68 of the limiter 63 also smooths the portion of the sealant 69 that enters the chip opening 64.

FIGS. 8 and 9 illustrate still another form of applicator 71 which is formed, for example, from a piece of cylindrical material. The lower end of the cylindrical stock is machined to give it a radius or semi-spherical surface 72 which functions similarly to the lower spherical surfaces of the applicators shown in FIGS. 1–7. The applicator 71 is fastened to the lower end of a supply tube (not shown) which may be similar to the tube 34, and the applicator 71 includes a limiter 73 which is in the form of a laterally extending pin similar to the limiter 53 shown in FIGS. 3 and 4. While the shape of the applicator 71 differs from the applicator 51 shown in FIGS. 3 and 4, the two applicators 71 and 51 function similarly because they both have a lower surface that is spherical or arcuate and which engages the corners of the groove and tools the upper surface of the sealant.

It will be apparent from the foregoing that a novel and useful sealant applicator has been provided. The applicator places a sufficient but not an excessive amount of sealant in the groove, and at the same time tools or shapes the sealant. It forms an arcuate recess in the sealant, the recess being greatest at the center of the groove, which prevents the tires of an automobile from sticking to the sealant when it has not yet cured. If a tire were to roll over and press into the partially cured sealant, the sealant would most likely stick to the tire and be pulled loose or out of the groove. This does not occur when using an applicator in accordance with this invention. Further, the limiter of the applicator prevents the applicator from moving too far into the groove. Since the lower sides of the applicator are symmetrical and the outlet opening is at the center, the applicator automatically functions to center the outlet opening despite variations in the width of the groove.

Other modifications and variations of the invention will become apparent to those skilled in the art from a reading of the above description of preferred embodiments. It is to be understood, therefore, that within the scope of the appended claims the invention may be practiced otherwise than as specifically described.

What is claimed is:

1. An applicator for placing and shaping a sealant into a groove to be sealed, comprising a member having a lower side having a convex arcuate shape for shaping said sealant, a sealant passape extending through said member and including an outlet opening in said lower side wherein no portion of said outlet opening projects beyond said arcuate lower side, said lower side of said applicator having a width substantially greater than the width of said groove to generally remain in contact with the edges thereof and a limiter attached to said member, said limiter extending laterally of said lower side of said member, whereby a portion of said arcuate surface of said lower side extends into said groove during use for shaping the upper surface of said sealant to a generally concave shape at the same time that said sealant is placed into said groove through said outlet opening.

2. An applicator according to claim 1, wherein said limiter comprises a substantially cylindrical pin.

3. An applicator according to claim 1, wherein said limiter comprises a plate attached to said member.

4. Apparatus for applying and shaping a sealant in a groove of a pavement, said groove having a lateral width, a longitudinal direction and upper corners, said apparatus comprising a supply arm, an applicator attached to an end of said arm, said arm and said applicator having communicating sealant flow passages therethrough, said applicator having a convex arcuate lower side for shaping said sealant and an outlet opening formed in said lower side wherein no portion of said outlet opening projects beyond said arcuate lower side, said outlet opening communicating with said passages, said applicator lower side having a greater lateral dimension than the lateral width of the groove, and said applicator having a limiter which extends laterally from said lower surface and is adapted to extend over said upper corners whereby said lower side normally engages said corners during use and said lower side partially extends into said groove during use for shaping the upper surface of said sealant to a generally concave shape at the same time that said sealant is placed into said groove through said outlet opening.

* * * * *